United States Patent [19]

Lucas

[11] Patent Number: 4,461,275

[45] Date of Patent: Jul. 24, 1984

[54] APPARATUS AND METHOD FOR BURNING WOOD

[76] Inventor: Charles D. Lucas, R.R. 1, Box 10, Salmon Arm, British Columbia, Canada, V0E 2T0

[21] Appl. No.: 314,778

[22] Filed: Oct. 26, 1981

[51] Int. Cl.[3] ..... F23L 13/00

[52] U.S. Cl. ..... 126/286; 126/290; 126/77; 126/72; 126/65

[58] Field of Search ..... 126/285 R, 286, 289, 126/290, 123, 131, 61, 63, 66, 72; 236/1 G

[56] References Cited

U.S. PATENT DOCUMENTS

| | | | |
|---|---|---|---|
| 2,636 | 5/1842 | Foote, Jr. . | |
| 1,014,032 | 1/1912 | Atterbury . | |
| 1,225,648 | 5/1917 | Kleckner . | |
| 2,170,728 | 8/1939 | Montague . | |
| 2,199,875 | 5/1940 | Brogden . | |
| 2,213,235 | 9/1940 | Adams . | |
| 2,309,295 | 1/1943 | Barnes | 126/290 |
| 2,467,577 | 4/1949 | Baldwin . | |
| 2,692,504 | 10/1954 | Colburn | 126/286 |
| 2,709,551 | 5/1955 | Bower et al. . | |
| 2,793,811 | 5/1957 | Coselman . | |
| 3,096,754 | 7/1963 | Howrey . | |
| 3,168,088 | 2/1965 | Martin et al. . | |
| 4,127,100 | 11/1978 | Baker | 126/61 |
| 4,305,373 | 12/1981 | Martenson | 126/131 |
| 4,385,620 | 5/1983 | Black | 126/290 |

*Primary Examiner*—Samuel Scott
*Assistant Examiner*—G. Anderson
*Attorney, Agent, or Firm*—Richards, Shefte & Pinckney

[57] ABSTRACT

A thermostatically actuated arrangement for controlling opening and closing movement of the damper of a wood burning stove includes a duct arrangement extending through the combustion chamber of the stove between an air intake end opening through the stove housing at a location in the lower portion thereof and a discharge end opening through the stove housing at a location upwardly spaced from the intake end, for passage of ambient air through the duct arrangement for radiant heating thereof during burning of wood in the stove to create a continuous convective flow of heated air from the intake end to the discharge end, and a sensitive bimetallic spring disposed to receive the convective air flow from the duct arrangement at its discharge end and operably associated with the damper of the stove for actuating opening and closing movements thereof in response to decreases and increases in the temperature of the airflow.

16 Claims, 3 Drawing Figures

Fig. 1
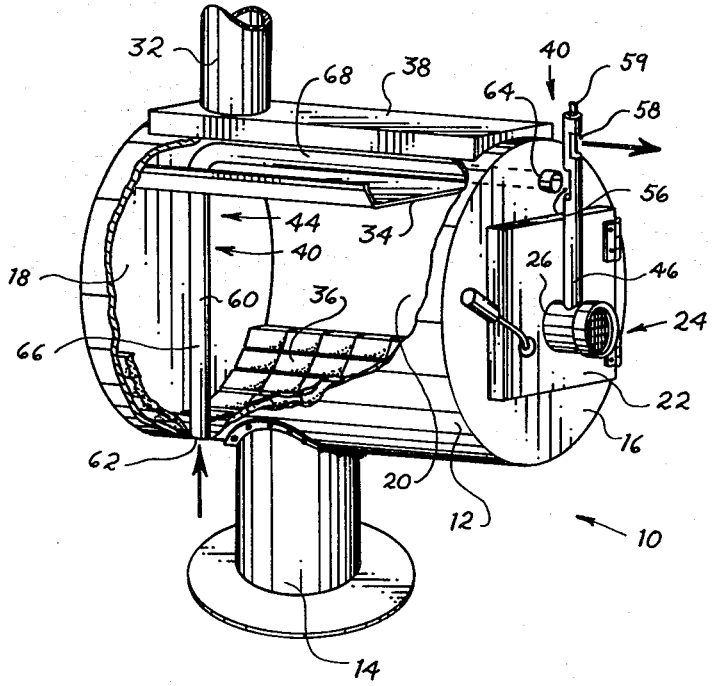
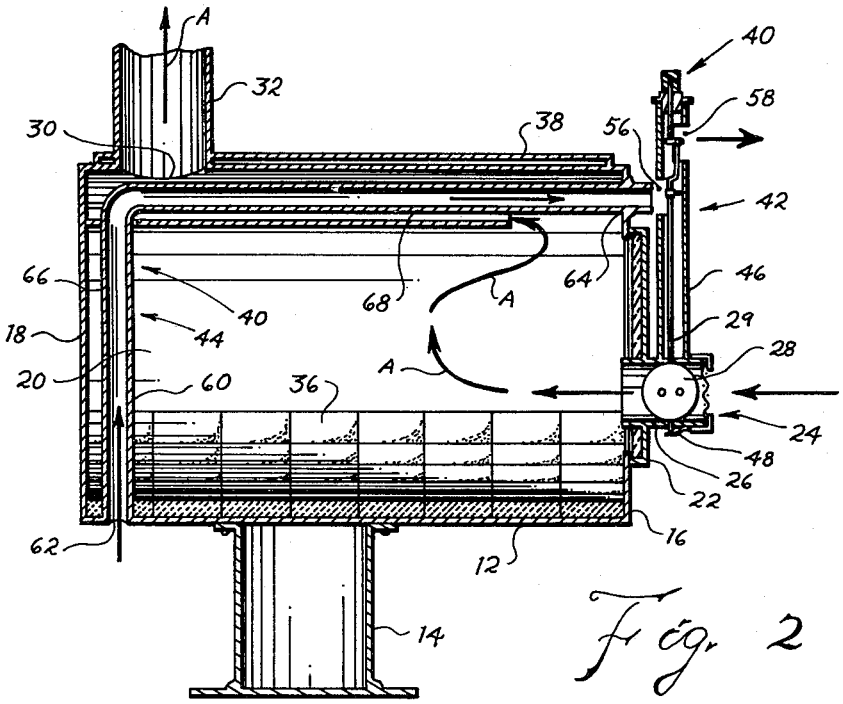
Fig. 2

59
42
54
52
68
56
16
50
64
29
46
26
29
28
48
24
16
22

APPARATUS AND METHOD FOR BURNING WOOD

BACKGROUND OF THE INVENTION

The present invention relates to apparatus and methods for burning wood to produce heat, e.g. wood-burning stoves, and more particularly to arrangements and methods employed therein for controlling the rate of burning of the wood.

With the increases of recent years in the cost and periodic shortages or unavailability of traditional heating fuels such as heating oil and natural gas, many less conventional methods of space heating have correspondingly grown in popularity. Wood, as a relatively inexpensive, plentiful and efficient alternative heating fuel, has resultingly enjoyed a veritable rebirth in use as a heating fuel, accompanied by a proliferation of manufacturing concerns producing and selling wood burning stoves. However, in addition to its advantages, the use of wood as a fuel also presents certain problems not ordinarily encountered with more traditional fuels. In the ordinary, uncontrolled burning of a given quantity of wood, three basic stages of burning progressively occur: an initial stage during which water in the wood is evaporated, a subsequent stage during which volatile materials in the wood are combusted, and a final stage during which charcoal resulting from the second stage is burned. Over the course of the three stages, the temperature and, accordingly, the heat output of the combustion gradually rise to a maximum temperature which is maintained for a relatively short time after which the temperature and heat output quickly decrease. As will therefore be understood, a general problem exists in the burning of wood for space heating purposes of modulating the temperature and heat output of the burning wood over the total time period of the combustion process.

As is known, wood burning stoves, in employing an enclosure for combustion therein of wood into which the flow of combustion air may be regulated, provide some control over the combustion process. Conventionally, several approaches have been employed in the design of wood burning stoves in attempting to solve or mitigate the above-described problems. According to one such approach, a wood burning stove is provided with a manually adjustable damper to permit the regulation of the quantity of combustion air admitted to the stove thereby to control the rate of burning. However, although stoves having dampers of this sort are effective in lengthening the period of time over which a given quantity of wood will burn as contrasted to the uncontrolled burning thereof, the burning nevertheless follows the three above-described stages and, accordingly, a common complaint of such stoves is the overheating which results during the second stage of burning.

In a conventional modification of this manually controlled damper arrangement, the damper is operatively connected to a thermostat mounted exteriorly on the stove for controlling opening and closing movements of the damper in response to changes in the temperature of air surrounding the stove and radiantly heated thereby. While stoves of this sort have been found to be relatively effective in generally modulating the heat output of the stove over the period of burning of a given quantity of wood and are advantageously inexpensive, such control arrangements, as a result of their disposition exteriorly of the stove in relatively still air and their reliance upon changes in the temperature of such still air thereat, experience a relatively substantial time delay in responding to changes in the internal temperature of the stove which, accordingly, produces a cyclic variance of relatively broad range in the heat output of the stove. Problems are experienced in such stoves in maintaining combustion of the wood at damper settings providing for minimal combustion air intake for low-level burning without extinguishing the fire from lack of air since the response time of the thermostatic damper control is generally not sufficiently quick to actuate opening movement of the damper once the thermostat senses the need for additional combustion air to modulate a decrease in the combustion temperature and, therefore, such stoves must ordinarily be operated utilizing a greater than desirable mean rate of air intake to offset this effect of the delayed response of such stoves, disadvantageously causing more rapid burning of the wood and overheating.

In contrast to the above, the present invention provides an improved thermostatic damper control arrangement and method for wood burning stoves and the like particularly adapted for actuating opening and closing movements of the air intake damper arrangement of such a stove quickly and accurately in response to the temperature and rate of burning of wood in the stove thereby permitting both the modulation of the heat output of the stove with reduced cyclic variation and little or no overheating, and the operation of the stove utilizing unconventionally low rates of air intake.

SUMMARY OF THE INVENTION

The present invention provides an improvement in apparatus for and methods of burning wood wherein a housing defining a combustion chamber therewithin is provided for containing a supply of wood for combustion thereof, an air intake damper arrangement is provided in the housing for admitting combustion air to the combustion chamber and is selectively openable and closeable for regulation of the quantity of combustion air admitted therethrough, and a flue opening is provided in the housing for exhaustion therethrough of products of the combustion of the wood. Briefly described, the present invention provides a duct arrangement extending through the combustion chamber between an intake end opening through said housing at a first location therein to communication with ambient air and a discharge end opening through the housing at a second location therein upwardly spaced from the first location to communication with ambient air for passage of a portion of ambient air through the duct arrangement for radiant heating thereof thereby to create a continuous convective flow of ambient air through the duct arrangement from the intake end to the discharge end. A thermostatic sensing arrangement is disposed to receive the convective flow downstream of the discharge end to sense the temperature of the ambient air of the convective flow and is operatively associated with the damper arrangement for actuating opening and closing movements thereof respectively in response to decreases and increases in the temperature of the ambient air of the convective flow. In this manner, the admission of combustion air through the damper arrangement to the combustion chamber is regulated quickly and accurately in responsive relation to variances in the temperature of the combustion of the wood.

In the preferred embodiment, the stove has front and rear ends, the damper arrangement being disposed in the front end and the flue opening being disposed adjacent the rear end, and a baffle member is disposed in the combustion chamber intermediate the supply of wood and the flue opening to cause the products of combustion to flow in a tortuous path about the baffle to the flue opening to slow the rate of exhaustion of the products of combustion. The duct arrangement includes a generally vertical leg extending upwardly from the intake end generally alongside the rear end and through the baffle member to a location closely adjacent the flue opening, and a generally horizontal leg extending from the upper end of the vertical leg to the discharge end. In this manner, ambient air rises in the vertical leg of the duct arrangement in response to radiant heating thereof and effectively, pushes the ambient air in the horizontal leg, which is radiantly heated by the products of combustion, toward the discharge end.

Preferably, the thermostatic sensing arrangement includes a tubular member vertically arranged adjacent the discharge end of the duct arrangement and having an air receiving opening facing the discharge end and an air exit opening spaced upwardly of the receiving opening, with a thermostatically sensitive element, e.g., a bimetallic spring, adapted to expand and contract in response to temperature changes being disposed in the tubular member at the exit opening. In this manner, the convective flow discharged from the duct arrangement continues to move convectively through the tubular member from its receiving opening to its exit opening and flows about the thermostatic element to effect expansion or contraction thereof in response to the temperature of the air of the convective flow. The element is operatively connected to the damper arrangement, which is preferably a valve member pivotable for opening and closing movement about a vertical shaft, for actuating movement thereof in response to contraction and expansion of the element.

BRIEF DESCRIPTION OF THE DRAWINGS

FIG. 1 is a perspective view of a wood burning stove in which is incorporated the preferred embodiment of the present invention, the housing of the stove being partially broken away to reveal the internal components thereof;

FIG. 2 is a vertical sectional view of the stove of FIG. 1 taken along line 2—2 thereof.

DESCRIPTION OF THE PREFERRED EMBODIMENT

Figure 3:
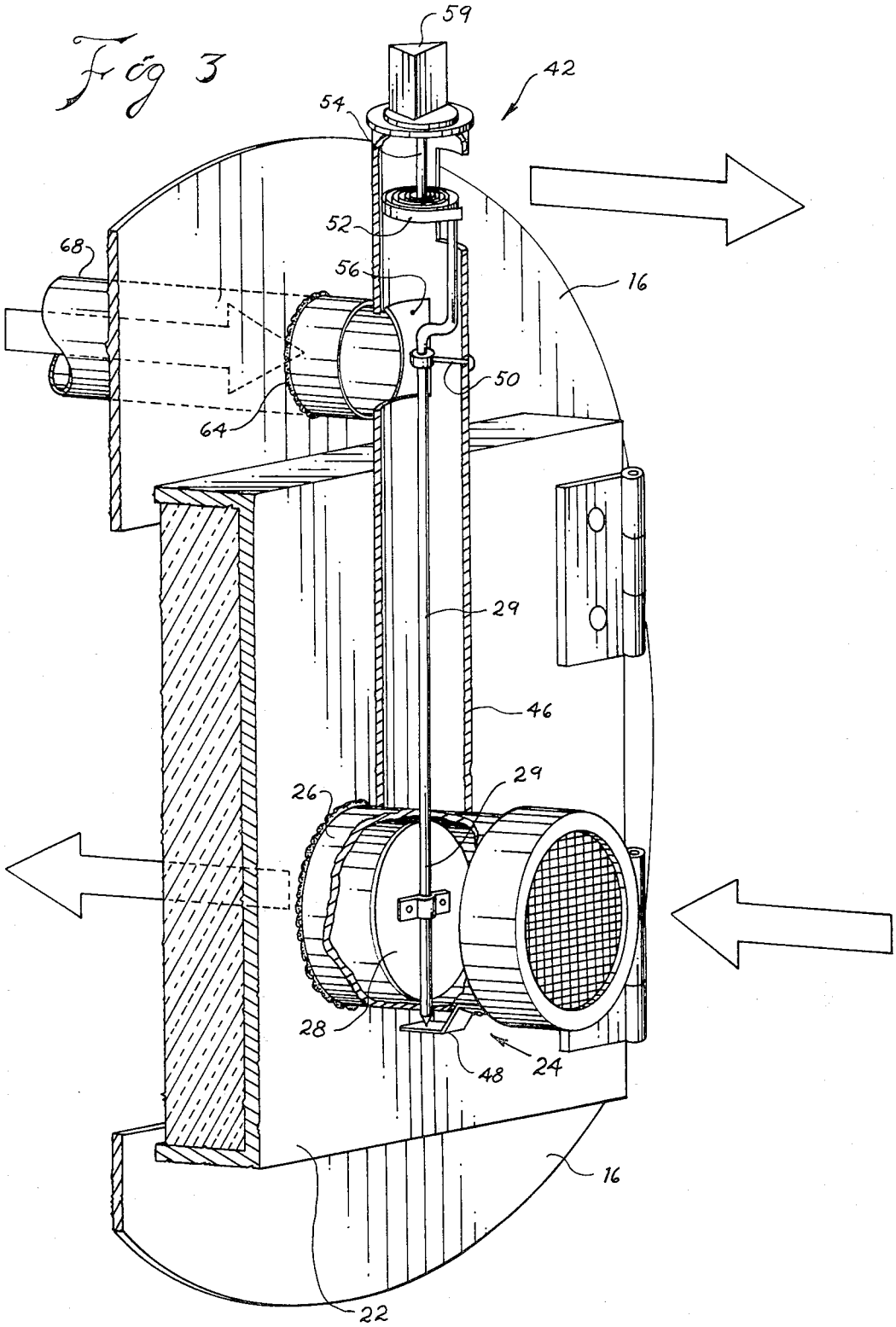
FIG. 3 is an enlarged perspective view of the front side of the stove of FIG. 1 with portions thereof partially broken away.

Referring now to the accompanying drawings and particularly to FIGS. 1 and 2, the present invention is illustrated in its preferred embodiment in a wood burning stove, indicated generally at 10. The stove 10 includes a substantially cylindrical housing 12 disposed horizontally and mounted on a pedastal 14, the housing 12 being provided with front and rear end walls 16,18 and defining therewithin a combustion chamber 20 for containing a supply of wood (not shown) for burning. An insulated door 22 in the front end wall 16 facilitates access to the combustion chamber 20 for the tending of burning wood therein and the addition of wood when necessary. Ambient combustion air is controlledly admitted to the combustion chamber 20 through an intake damper assembly 24 in the lower portion of the front end wall 16, the damper assembly 24 including a short, horizontally-extending cylindrical tube 26 opening at one end to communication with the combustion chamber 20 and at its other end to communication with the ambient atmosphere, a butterfly valve 28 being disposed within the tube 26 and mounted on a vertically-extending longitudinal shaft 29 for movement about the axis of the shaft 29 to open and close the combustion chamber 20 to communication to the ambient atmosphere thereby to regulate the quantity of combustion air admitted to the combustion chamber 20. A flue opening 30 is provided in the upwardly facing portion of the housing 12 adjacent the rear end wall 18 and provides communication between the combustion chamber 20 and an exhaust stack 32 for exhaustion through the flue opening 30 and the exhaust stack 32 of the products of the combustion of the wood.

A generally rectangular baffle plate 34 is generally horizontally disposed in the upper portion of the combustion chamber 20 at a relatively slight downward spacing from the flue opening 30, the rear edge of the plate 34 being affixed to the interior surface of the rear end wall 18 of the housing 12 and the side edges of the plate 34 being affixed to the interior surface of the cylindrical portion of the housing 12 at opposite sides thereof with the front edge of the plate 34 being spaced rearwardly from the front end wall of the housing 12. In this manner, the flow of combustion air and products of combustion through the combustion chamber 20 of the stove between the damper assembly 24 and the flue opening 30 is caused to follow a tortuous path generally of "S" shape; i.e., combustion air enters the combustion chamber 20 through the damper assembly 24 in a generally horizontal direction and, as the air flows toward the rear end wall 18 of the housing 12 and fuels the combustion of the wood, the air and the products of combustion are heated, rise toward the baffle plate 34, flow therealong toward the front end wall 16 of the housing, pass around the front edge of the baffle plate 34, and flow rearwardly thereabove to the flue opening 30, all as indicated by arrows A in FIG. 2. Advantageously, little of the entering combustion air flows rearwardly beyond the forward portion of the burning wood, which therefore progressively burns slowly from the forwardmost to the rearwardmost portions thereof in the manner of a cigar. Furthermore, the tortuous exhaust flow path created by the baffle plate 34 delays the exhaustion of the products of combustion to enhance substantially complete combustion of initially uncombusted or partially combusted volatile materials therein and thereby facilitates the extraction of more heat from the wood.

The lower portion of the interior of the housing 12 is lined with several rows of conventional fire brick 36 to provide a supplementary thermal mass to absorb, retain and slowly release the heat produced by the combustion of the wood. A substantially flat cover member 38 is affixed exteriorly to the upwardly facing portion of the housing 12 to provide a flat surface for miscellaneous purposes such as the warming of food.

As will be appreciated by those skilled in the art, the hereinabove described features of the stove 10 are conventional. According to the present invention, a thermostatically actuated damper control arrangement, generally indicated in FIGS. 1 and 2 at 40, is provided which is sensitive and quickly responsive to fluctuations in the temperature of the products of combustion exhausted from the combustion chamber 20 of the stove 10. It is known that the temperature of the exhausted products of wood combustion is one of the most sensitive and accurate indicators of the rate of the combustion of the wood, and it is also known that thermostatic sensing arrangements are as a general rule considerably more quickly responsive to temperature changes in moving air than relatively stagnant air. However, it has generally been considered impractical, if not impossible, to provide a thermostatically sensitive control element internally within the stove or its flue for reaction to the temperature and movement of the products of combustion and, accordingly, conventional wisdom is that the most accurate and practical thermostatic control arrangement available is one of the above-described type which is arranged exteriorly of the stove for radiant heating thereby to react to changes in the radiant temperature of the stove. As previously indicated, several disadvantages accrue from this type of arrangement principally of which are the inaccuracy of gauging the changes in the rate of burning and internal temperature of the stove from the temperature of the exterior air radiantly heated by the stove and the relatively slow responsiveness of such an arrangement to changes in the temperature of the relatively still air surrounding the stove which is radiantly heated thereby.

The arrangement 40 of the present invention in contrast provides a thermostatically sensitive control assembly, generally indicated at 42 in FIGS. 1 and 3, operatively associated with the damper assembly 24 for actuating opening and closing movements of the valve 28 thereof in response to sensed temperature variations, and a duct arrangement, indicated generally at 44 in FIG. 1, extending in and through the housing 12 for creating a continuous convective flow of air through the combustion chamber for radiant heating by the combustion occurring therein and the products of combustion being exhausted therefrom and directing the heated air to and through the control assembly 42 for sensing of the temperature thereof.

The control assembly 42 may best be seen in FIG. 3 and includes a tubular member 46 extending vertically from the cylindrical tube 26 adjacent the front end wall 16 of the housing 12 substantially coaxially with the axis of movement of the butterfly valve 28, the shaft 29 on which the valve 28 is mounted extends along the axis of movement thereof and centrally within the tubular member 46. The lower end of the shaft 29 is journaled in and extends through the tube 26 and is supported for rotational movement on a platform support member 48 affixed to the underside of the tube 26, the lower end of the shaft 29 being tapered to the point of contact with the platform member 48 to reduce frictional resistance therebetween to rotational movement of the shaft 29. A guide element 50 extending radially inwardly of the tubular member 46 provides support for the shaft 29 at a relatively small downward spacing from its upper end, a radially outward bend being provided in the shaft 29 immediately above the guide element 50. The upper end of the shaft 29 is affixed to the radially outwardmost end of a conventional bimetallic coil spring 52 and another shaft 54 is affixed to the radially inwardmost end of the spring 52 and is disposed coaxially with the axis of movement of the shaft 29 and the valve 28, the rod 54 being rotatably journaled in a cap affixed on the top of the tubular member 46.

As is conventionally known, the bimetallic spring 52 is thermostatically effective to expand and contract, and thereby coil and uncoil, in response and relation to changes in the ambient temperature. As will be understood by those skilled in the art, modulation of the rate of burning of wood in a stove of the present type is effected by closing movement of the damper valve in response to increases in the temperature of burning of the wood thereby to decrease the supply of air to the burning wood and lower the temperature thereof and by opening movement of the damper valve in response to decreases in the temperature of the burning of the wood thereby to increase the supply of air to the burning wood and increase the temperature thereof. Accordingly, the butterfly valve 28 is affixed to the shaft 29 relative to the coiling and uncoiling characteristics of the spring 52 for opening and closing movement of the valve 28 in respective response to temperature decreases and increases sensed by the spring 52. As may be best seen from FIG. 3, the spring 52 illustrated is of the type adapted to uncoil in response to temperature decreases and to coil in response to temperature increases, whereby, upon sensed temperature decreases, the uncoiling motion of the spring 52 will cause its radially outwardmost end to be arcuately displaced in a clockwise direction as viewed in FIG. 3 and will correspondingly impart clockwise rotational movement to the shaft 29 and the valve 28 to effect opening of the damper arrangement 24, while, conversely, sensed temperature increases will effect coiling of the spring 52 causing counterclockwise arcuate displacement of its outermost end and corresponding rotation of the shaft 29 and the valve 28 to effect closing of the damper arrangement 24. As will additionally be understood, the degree of coiling and uncoiling of the spring 52 will be relative to the degree of the sensed temperature change whereby the degree of displacement of the outermost end of the spring 52 and the degree of rotation of the shaft 29 and the valve 28 are related to the degree of the sensed change in temperature.

To permit airflow through the tubular member 46 and about the spring 52 to best facilitate the responsiveness thereof, two vertically spaced openings 56,58 are formed in the tubular member 46 on opposite sides thereof, the lower opening 56 being spaced lightly below the location of the spring 52 and facing the front side wall 16 of the housing 12 and the upper opening 58 being located adjacent the spring 52 and facing generally outwardly from the housing 12. In this manner, the tubular member 46 provides a partially enclosed chamber through which air may convectively move from the opening 56 to the opening 58 and by which air may be transiently confined and caused to pass through and about the spring 52 for sensing thereof and response thereto. A knob 59 is provided on the cap of the tubular member 46 operably joined to the rod 54 to permit manual positioning of the butterfly valve 28, the spring 52 further positioning the butterfly valve 28 from the manually positioned setting in response to temperature changes as hereinafter explained. In order that a manual setting holds its position against the counter torque of the spring 52, a flat disc magnet (not shown) is provided under the knob 59 to prevent undesired rotation of the knob 59.

The duct arrangement 44 may best be seen in FIGS. 1 and 2 and includes a tubular duct 60 extending interiorly through the combustion chamber 20 of the housing 12 between an intake end 62 opening through the housing 12 to communication with the ambient air at a location in the downwardly facing surface of the cylindrical portion of the housing 12 closely adjacent the rear wall 18 and a discharge end 64 opening through the housing 12 to communication with the ambient air at a location in the front end wall 16 of the housing 12 above the door 22 at an upward spacing from the intake end location and immediately adjacent the opening 56 of the tubular member 46 of the control assembly 42. A vertical leg 66 of the duct 60 extends upwardly from the intake end 62 adjacent the rear side wall 18 and through the baffle plate 34 to a location closely adjacent the flue opening 30, a horizontal leg 68 of the duct 60 extending forwardly from the upper end of the vertical leg 66 intermediately of the baffle member 34 and the upper interior surface of the housing 12 to the discharge end 64. In this manner, a portion of the ambient air is permitted to freely enter and fill the duct 60 and, upon the preparation of a wood fire in the combustion chamber 20, the ambient air occupying the duct 60 will be radiantly heated whereby the air in the vertical leg 66 will rise therein by natural convection and such movement of the air occupying the vertical leg 66 will be effective to push the air in the horizontal leg 68 therethrough, creating a continuous convective flow of outside air through the duct 60 from its intake to its discharge ends 62,64. As will be understood, the air occupying the vertical leg 66 will be heated primarily by the combustion occurring in the combustion chamber 20, while the air in the horizontal leg 68 will be heated primarily by the the exhausting products of combustion, the length of the duct 60 and its afore-described construction and disposition being effective to heat the air flowing therethrough substantially to the temperature of the exhausting products of combustion. The extension of the horizontal leg 68 through the housing 12 at the discharge end 64 to a location immediately adjacent the opening 56 of the tubular member 46 is effective to direct the heated air exiting the duct 60 into the opening 56 of the tubular member 46 within which the air rises by natural convection, passes through and about the bimettalic spring 52, and exits to the ambient atmosphere through the opening 58. As previously indicated, the spring 52 accordingly senses and expands or contracts in response to changes in the temperature of this airflow and actuates opening or closing movement of the butterfly valve 28 in respective response to decreases and increases in the sensed temperature.

It will therefore be understood that, in contrast to and improvement of the above-described conventional thermostatically sensitive damper control arrangements presently incorporated in wood burning stoves, the arrangement 40 of the present invention provides an independent, continuously-moving convective flow of air heated to substantially the temperature of the products of combustion continuously being exhausted from the stove 10 and continuously directs such air flow through the control assembly 42 for continuous responsive reaction by the spring 52 to the temperature of the air flow. Two distinct advantages, among others, are obtained by this arrangement over the conventional arrangement. First, the air flow, being heated to the temperature of the products of combustion exhausting from the stove 10, provides a significantly more accurate indication of the rate of combustion of the wood in the stove than does the air surrounding the exterior of the stove and radiantly heated thereby and, accordingly, facilitates more accurate modulation of the rate of burning of the wood. Second, the movement of the airflow through and about the spring 52 effects substantially quicker expansional and contractional reaction thereof to changes in the temperature of the air flow than can be achieved by a thermostatic element disposed in the generally still air surrounding the stove. As a result, the control of the intake by the stove 10 of combustion air by the actuation of opening and closing movements of the butterfly valve 28 of the damper assembly 24 is very quickly and accurately effected in response to changes in the temperature of the products of combustion, thereby reducing the amplitude of the cyclic variations in the heat output of the stove 10 and further permitting the setting of the damper assembly at significantly lower than conventional rates of air intake through the damper assembly.

While the present invention has herein been illustrated and described herein in the preferred embodiment thereof for purposes of illustration, those skilled in the art will readily recognize that the preferred embodiment is susceptible to modification without departing from the substance and scope of the invention. For instance, it is contemplated that the vertical leg 66 of the duct arrangement 60 may be formed as a double walled rear end wall 18 of the housing 12 for the additional purpose of maintaining the rear end wall 18 sufficiently cool to permit the placement of the stove 10 closely adjacent interior building walls. Modifications such as this are considered to be within the substance and scope of the present invention, which is intended to be limited only by the appended claims and equivalents thereof.

I claim:

1. In an apparatus for burning wood of the type having a housing defining therewithin a combustion chamber for containing a supply of wood for combustion thereof, air intake damper means in said housing for admitting combustion air to said combustion chamber, said damper means being selectively openable and closeable for regulation of the quantity of said combustion air admitted therethrough, and a flue opening in said housing for exhaustion therethrough of products of said combustion of said wood, the improvement comprising duct means extending through said combustion chamber between an intake end opening through said housing at a first location therein to communication with ambient air and a discharge end opening through said housing at a second location therein upwardly spaced from said first location to communication with ambient air for non-forced passage of a portion of said ambient air through said duct means for radiant heating of said ambient air portion in said duct means during burning of said wood thereby to create a continuous natural convective flow of said ambient air through said duct means from said intake end to said discharge end for heating of said ambient air generally to the temperature of said combustion of said wood, and thermostatic sensing means disposed to receive said convective flow downstream of said discharge end to sense the temperature of said ambient air of said convective flow and operatively associated with said damper means for actuating opening and closing movements thereof respectively in response to decreases and increases in the temperature of said ambient air of said convective flow, thereby to provide regulation of the admission of said combustion air through said damper means to said combustion chamber quickly and accurately in direct responsive relation to variances in the temperature of said combustion of said wood.

2. The improvement in an apparatus for burning wood according to claim 1 and characterized further in that said duct means is arranged to extend intermediate said supply of wood and said flue opening for radiant heating of said ambient air in said duct means by said products of combustion.

3. The improvement in an apparatus for burning wood according to claim 2 and characterized further in that said duct means extends adjacent said flue opening.

4. The improvement in an apparatus for burning wood according to claim 3 and characterized further in that said duct means includes a generally vertical leg extending upwardly from said intake end and a generally horizontal leg extending from said vertical leg to said discharge end, whereby said ambient air in said vertical leg rises from said intake end in response to said radiant heating and effectively pushes said outside air in said horizontal leg toward said discharge end.

5. The improvement in an apparatus for burning wood according to claim 4 and characterized further by a baffle member disposed intermediate said supply of wood and said flue opening for causing said products of combustion to flow in a tortuous path thereabout to said flue opening to slow the rate of exhaustion of said products of combustion, said vertical leg extending through said baffle member and said horizontal leg extending between said baffle member and said flue opening for radiant heating of said horizontal leg and said ambient air therein by said products of combustion.

6. The improvement of an apparatus for burning wood according to claim 4 or 5 and characterized further in that said stove has front and rear ends, said damper means being disposed in said front end and said flue opening being disposed adjacent said rear end, said vertical leg extending generally adjacent said rear end to a location closely adjacent said flue opening and said horizontal leg extending from said closely adjacent location across said flue opening.

7. The improvement of an apparatus for burning wood according to claim 1 or 5 and characterized further in that said thermostatic sensing means comprises a thermostatically sensitive element adapted to expand and contract in response to temperature changes, said element being operatively connected to said damper means for actuating movement thereof in response to contraction and expansion of said element.

8. The improvement in an apparatus for burning wood according to claim 7 and characterized further in that said thermostatically sensitive element comprises a bimetallic spring.

9. The improvement in an apparatus for burning wood according to claim 8 and characterized further in that said damper means comprises a valve member pivotably disposed for opening and closing movements about a substantially vertical shaft, said thermostatic sensing element being operatively connected to said shaft for actuating said movements.

10. The improvement in an apparatus for burning wood according to claim 7 and characterized further in that said thermostatic sensing means comprises means defining an at least partially enclosed chamber arranged adjacent said discharge end for receiving and transiently confining within said chamber said convective flow of ambient air of said duct means, said element being disposed in said chamber.

11. In an apparatus for burning wood of the type having a housing defining therewithin a combustion chamber for containing a supply of wood for combustion thereof, air intake damper means in said housing for admitting combustion air to said combustion chamber, said damper means being selectively openable and closeable for regulation of the quantity of said combustion air admitted therethrough, and a flue opening in said housing for exhaustion therethrough of products of said combustion of said wood, the improvement comprising duct means extending through said combustion chamber between an intake end opening through said housing at a first location therein to communication with ambient air and a discharge end opening through said housing at a second location therein upwardly spaced from said first location to communication with ambient air for passage of a portion of said ambient air through said duct means for radiant heating of said ambient air portion in said duct means during burning of said wood thereby to create a continuous convective flow of said ambient air through said duct means from said intake end to said discharge end, and thermostatic sensing means comprising a tubular member generally vertically arranged adjacent said discharge end of said duct means, said tubular member having formed therein an air flow receiving opening substantially facing said discharge end and an air flow exit opening spaced upwardly from said receiving opening and said tubular member defining an at least partially enclosed chamber between said receiving and exit openings for receiving and transiently confining within said chamber said convective flow of ambient air of said duct means, and a thermostatically sensitive element adapted to expand and contract in response to temperature changes disposed in said chamber generally at said exit opening to sense the temperature of said ambient air of said convective flow and being operatively connected to said damper means for actuating opening and closing movements thereof in response to contraction and expansion of said element, thereby to provide a path for continued convective movement of said convective flow of said duct means through said chamber from said receiving opening to said exit opening to cause said convective flow to pass about said element thereby to provide regulation of the admission of said combustion air through said damper means to said combustion chamber quickly and accurately in reponsive relation to variances in the temperature of said combustion of said wood.

12. In a method of burning wood including the steps of combusting a supply of wood in an enclosure, admitting combustion air to said enclosure and exhausting from said enclosure products of said combusting, the improvement comprising regulating said admitting of said combustion air to said enclosure in response to changes in the temperature of said combusting by providing an air flow path extending through said enclosure between an air intake location and an upwardly spaced air discharge location and sealed from said enclosure and communicating with ambient air at each said location, creating a continuous non-forced natural convective flow of said ambient air in said air flow path from said air intake location to said air discharge location by radiantly heating said ambient air in said air flow path generally to the temperature of said combustion of said wood, sensing the temperature of said ambient air of said convective flow downstream of said air discharge location, and increasing and decreasing said admitting said combustion air to said enclosure in respectively direct responsive relation to decreases and increases in said temperature of said ambient air of said convective flow.

13. The improvement in a method of burning wood according to claim 12 and characterized further in that said providing an air flow path includes directing said air flow path to extend through the exhausting path of travel of said products of said combusting, said radiantly heating including heating said ambient air in said flow path by said products of said combusting.

14. The improvement in a method of burning wood according to claim 13 and characterized further in that said providing an air flow path includes providing a vertical flow path portion extending generally vertically in said enclosure from said air intake location and providing a horizontal flow path portion extending horizontally from said vertical portion to said air discharge location.

15. The improvement in a method of burning wood according to claim 14 and characterized further in that said exhausting includes causing said products of said combusting to flow in a tortuous path, said providing a horizontal flow path portion including locating said horizontal portion to extend in said tortuous path.

16. The improvement in a method of burning wood according to claim 12 or 15 and characterized further in that said sensing includes exposing a thermostatically sensitive element to said ambient air of said convective flow downstream of said air discharge location.

* * * * *